US007333028B2

(12) United States Patent
Schwartz

(10) Patent No.: US 7,333,028 B2
(45) Date of Patent: Feb. 19, 2008

(54) TRAFFIC PREEMPTION SYSTEM COMMUNICATION METHOD

(75) Inventor: Mark A. Schwartz, River Falls, WI (US)

(73) Assignee: Global Traffic Technologies, LLC, Oakdale, MN (US)

( * ) Notice: Subject to any disclaimer, the term of this patent is extended or adjusted under 35 U.S.C. 154(b) by 98 days.

(21) Appl. No.: 11/142,019

(22) Filed: Jun. 1, 2005

(65) Prior Publication Data

US 2006/0273925 A1 Dec. 7, 2006

(51) Int. Cl.
*G08G 1/095* (2006.01)

(52) U.S. Cl. ..... 340/907; 340/906; 340/924; 701/117

(58) Field of Classification Search ..... 340/906, 340/907, 908, 436, 909, 910, 911, 924, 902, 340/991, 992, 993; 701/201, 202, 207, 213, 701/208, 117

See application file for complete search history.

(56) References Cited

U.S. PATENT DOCUMENTS

| | | | |
|---|---|---|---|
| 3,550,078 | A | 12/1970 | Long |
| 3,831,039 | A | 8/1974 | Henschel |
| 4,162,447 | A | 7/1979 | Teshirogi et al. |
| 4,162,477 | A | 7/1979 | Munkberg |
| 4,228,419 | A | 10/1980 | Anderson |
| 4,230,992 | A | 10/1980 | Munkberg |
| 4,234,967 | A | 11/1980 | Henschel |
| 4,463,339 | A | 7/1984 | Frick et al. |
| 4,680,811 | A | 7/1987 | Harper et al. |
| 4,704,610 | A | 11/1987 | Smith et al. |
| 4,717,913 | A | 1/1988 | Elger |
| 4,727,600 | A | 2/1988 | Avakian |
| 4,734,881 | A | 3/1988 | Klein et al. |
| 4,914,434 | A | 4/1990 | Morgan et al. |
| 4,970,439 | A | 11/1990 | Stopa |
| 4,972,185 | A | 11/1990 | Stopa et al. |
| 4,992,790 | A | 2/1991 | Montgomery |
| 5,014,052 | A | 5/1991 | Obeck |
| 5,159,480 | A | 10/1992 | Gordon et al. |

(Continued)

OTHER PUBLICATIONS

"Strobecom II, Optical Preemption and Priority Control System", http://www.tomar.com/strobecom/index.htm, 3, pages. Printed from Internet Feb. 8, 2005.

(Continued)

*Primary Examiner*—Anh V. La
(74) *Attorney, Agent, or Firm*—Schwegman, Lundberg & Woessner, P.A.

(57) ABSTRACT

A remotely-controlled traffic-preemption system and method includes an encoder circuit, an optical source, an optical detector, and a decoder circuit. The encoder circuit is adapted to generate a set of signal pulses. At least one bit of a data word is encoded as a function of amplitude modulation of a first subset of the set of signal pulses and at least another bit of the data word is encoded as a function of frequency modulation of a second subset of the set of signal pulses. The optical source is adapted to transmit a set of light pulses having a respective light pulse for each signal pulse of the set of signal pulses. The optical detector is adapted to receive the set of light pulses. The decoder circuit is adapted to generate the data word from the set of light pulses received at the optical detector.

20 Claims, 6 Drawing Sheets

U.S. PATENT DOCUMENTS

| | | | | |
|---|---|---|---|---|
| 5,172,113 | A | 12/1992 | Hamer | |
| 5,187,373 | A | 2/1993 | Gregori | |
| 5,187,476 | A | 2/1993 | Hamer | |
| 5,202,683 | A | 4/1993 | Hamer et al. | |
| 5,519,389 | A | 5/1996 | DeGunther et al. | |
| 5,539,398 | A | 7/1996 | Hall et al. | |
| 5,602,739 | A | 2/1997 | Haagenstad et al. | |
| 5,926,113 | A | 7/1999 | Jones et al. | |
| 5,986,575 | A | 11/1999 | Jones et al. | |
| 6,243,026 | B1 | 6/2001 | Jones et al. | |
| 6,281,808 | B1 * | 8/2001 | Glier et al. | 340/933 |
| 6,429,812 | B1 * | 8/2002 | Hoffberg | 342/357.1 |
| 6,621,420 | B1 * | 9/2003 | Poursartip | 340/907 |

OTHER PUBLICATIONS

Tomar Electronics, "Strobecom II", System Manual (Rev 3), Jun. 2000, 25 pages. Jun. 2000.

Tomar Electronics, "Strobecom II. Optical Signal Processor Configuration Software (OSPsoft)," User's Manual, Version 2.0 for use with OSP Version 2.0, May 2000, 40 pages. May 2000.

"Elock™ Emitter Authenticator," http://www.tomar.com/products/elock/elock.htm, 11 pages. Printed from Internet Apr. 27, 2005.

* cited by examiner

TRAFFIC PREEMPTION SYSTEM COMMUNICATION METHOD

FIELD OF THE INVENTION

The present invention is generally directed to systems and methods that allow traffic light systems to be remotely controlled using high-integrity data communication, for example, involving optical pulse transmission from an optical emitter to an optical detector that is communicatively-coupled to a traffic light controller at an intersection.

BACKGROUND OF THE INVENTION

Traffic signals have long been used to regulate the flow of traffic at intersections. Generally, traffic signals have relied on timers or vehicle sensors to determine when to change the phase of traffic signal lights, thereby signaling alternating directions of traffic to stop, and others to proceed. This situation is commonly exemplified in an emergency-vehicle application.

Emergency vehicles, such as police cars, fire trucks and ambulances, are generally permitted to cross an intersection against a traffic signal. Emergency vehicles have typically depended on horns, sirens and flashing lights to alert other drivers approaching the intersection that an emergency vehicle intends to cross the intersection. However, due to hearing impairment, air conditioning, audio systems and other distractions, often the driver of a vehicle approaching an intersection will not be aware of a warning being emitted by an approaching emergency vehicle.

There are presently a number of known optical traffic priority systems that permit for a fixed code to be embedded into the data stream to identify each vehicle and provide security. Such a code can be compared to a list of authorized codes at the intersection to restrict access by unauthorized users. This approach can be disadvantageous for certain applications or environments. For example, one problem with this approach arises when the transmitted data protocol is generally known or can easily be intercepted and re-created by unauthorized users. Once the transmitted data has been decoded or the transmitted data has been recorded for future playback, an unauthorized device can be used to activate the system. In addition, an unauthorized device can be used to activate the system without intercepting any transmitted data by attempting to activate the system using various codes until a code is discovered that successfully activates the system.

There are some straight-forward approaches for preventing such unauthorized access to the traffic light control systems. One approach is to remove any such intercepted or discovered code from the system database altogether. Coordination of such removal, however, can be burdensome and expensive since the vehicle code and the authorized code list at each intersection would need to be changed: Another approach is to prevent the unauthorized use by equipping all authorized vehicles, as well as the intersection (traffic light control) systems, with special communication transceivers that interact to provide another layer of security before providing access to the traffic light control systems. This approach can also be burdensome and expensive since each of the vehicles, as well as the systems at each intersection, would need additional equipment.

SUMMARY OF THE INVENTION

The present invention is directed to overcoming the above-mentioned challenges and others that are related to the types of approaches and implementations discussed above and in other applications. The present invention is exemplified in a number of implementations and applications, some of which are summarized below.

In connection with one embodiment, the present invention is directed to implementations that allow traffic light systems to be remotely controlled using high-integrity data communication. One such implementation employs optically encoded data being transmitted to traffic light control equipment located at an intersection.

In a more particular example embodiment, a remotely-controlled traffic-preemption system includes an encoder circuit, an optical source, an optical detector, and a decoder circuit. The encoder circuit is adapted to generate a set of signal pulses. At least one bit of a data word is encoded as a function of amplitude modulation of a first subset of the set of signal pulses and at least another bit of the data word is encoded as a function of frequency modulation of a second subset of the set of signal pulses. The optical source is adapted to transmit a set of light pulses having a respective light pulse for each signal pulse of the set of signal pulses. The optical detector is adapted to receive the set of light pulses. The decoder circuit is adapted to generate the data word from the set of light pulses received at the optical detector.

In another more particular example embodiment, a communication method is provided for use in a remotely-control traffic-preemption system. At least one bit of a data word is encoded as a function of amplitude modulation of a first subset of a set of optical pulses and at least another bit of the data word is encoded as a function of frequency modulation of a second subset of the set of optical pulses. The set of optical pulses is transmitted to an optical detector. The data word is decoded from the optical pulses received at the optical detector.

The above summary of the present invention is not intended to describe each illustrated embodiment or every implementation of the present invention. The figures and detailed description that follow more particularly exemplify these embodiments.

BRIEF DESCRIPTION OF THE DRAWINGS

The invention may be more completely understood in consideration of the detailed description of various embodiments of the invention in connection with the accompanying drawings, in which.

Figure 1:
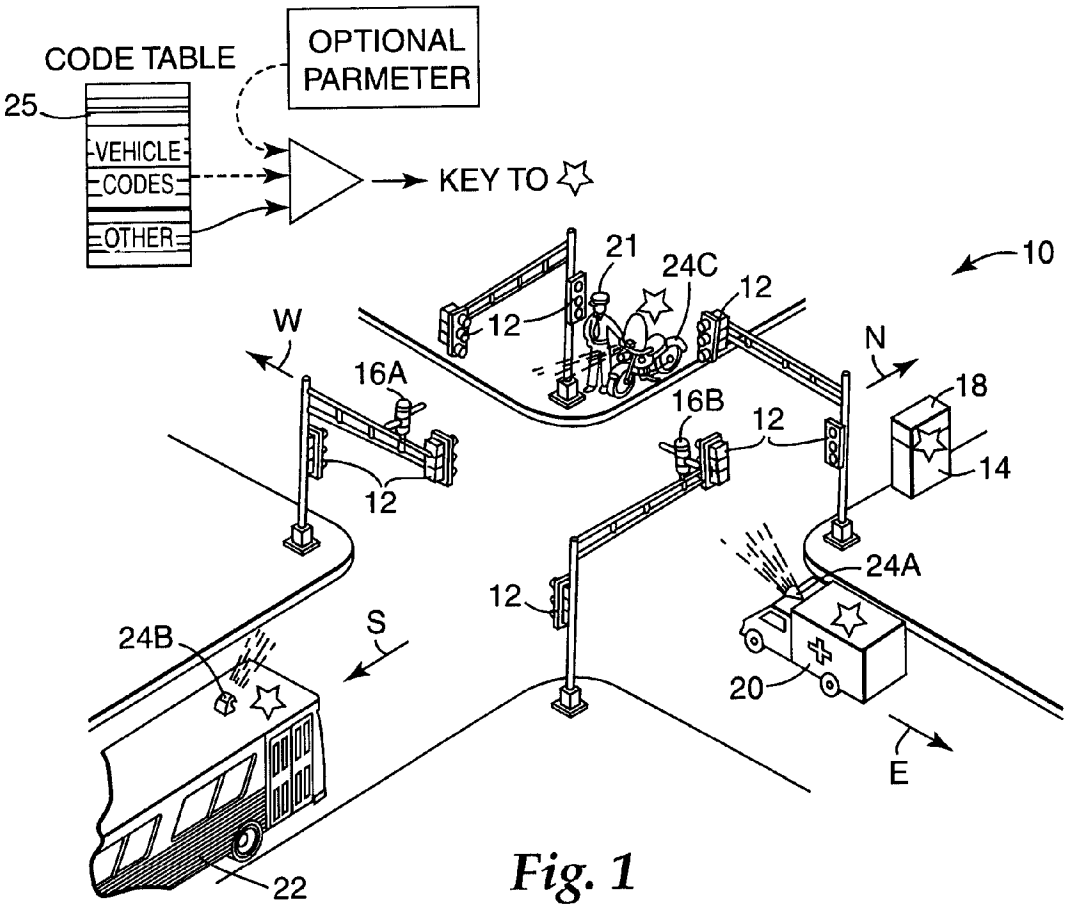
FIG. 1 is a perspective view of a bus and an ambulance approaching a typical traffic intersection, with emitters mounted to the bus, the ambulance and a motorcycle each transmitting an optical pulses in accordance with the present invention.

While the invention is amenable to various modifications and alternative forms, specifics thereof have been shown by way of example in the drawings and will be described in detail. It should be understood, however, that the intention is not necessarily to limit the invention to the particular embodiments described. On the contrary, the intention is to cover all modifications, equivalents, and alternatives falling within the spirit and scope of the invention as defined by the appended claims.

DETAILED DESCRIPTION OF VARIOUS EMBODIMENTS

The present invention is believed to be applicable to a variety of different types of validation of operation requests in an optical traffic preemption system. While the present invention is not necessarily limited to such approaches, various aspects of the invention may be appreciated through a discussion of various examples using these and other contexts.

The optical traffic preemption system shown in FIG. 1 is presented at a general level to show the basic circuitry used to implement example embodiments of the present invention. In this context, FIG. 1 illustrates a typical intersection 10 having traffic lights 12. A traffic signal controller 14 sequences the traffic lights 12 through a sequence of phases that allow traffic to proceed alternately through the intersection 10. The intersection 10 is equipped with an optical traffic preemption system having certain aspects and features enabled in accordance with the present invention to provide communication in an efficient, flexible and practicable manner.

This communication is provided in the optical traffic preemption system of FIG. 1 by way of optical emitters 24A, 24B and 24C, detector assemblies 16A and 16B, and a phase selector 18. The detector assemblies 16A and 16B are stationed to detect light pulses emitted from authorized vehicles approaching the intersection 10. The detector assemblies 16A and 16B communicate with the phase selector 18, which is typically located in the same cabinet as the traffic controller 14, and which differentiates between authorized vehicles and unauthorized vehicles using a high-integrity, yet practicable approach.

In FIG. 1, an ambulance 20 and a bus 22 are approaching the intersection 10. The optical emitter 24A is mounted on the ambulance 20 and the optical emitter 24B is mounted on the bus 22. The optical emitters 24A and 24B each transmit a stream of light pulses. The stream of light pulses can transport codes that identify a requested command or operation. The detector assemblies 16A and 16B receive these light pulses and send an output signal to the phase selector 18. The phase selector 18 processes and validates the output signal from the detector assemblies 16A and 16B. For certain validated output signals, the phase selector 18 issues a traffic preemption command to the traffic signal controller 14 to preempt the normal operation of the traffic lights 12.

In various embodiments, communication is provided by encoding the requested command or operation using both amplitude modulation and frequency modulation of certain subsets of the light pulses. In certain embodiments, the encoding of the requested command or operation can be modified, including modification by changing the light pulses that receive amplitude modulation and/or changing the light pulses that receive frequency modulation. It will be appreciated that a specific light pulse can have only amplitude modulation, only frequency modulation, or both amplitude and frequency modulation. The specific amplitude modulation and frequency modulation used for an encoding can be based on a key, and modification of the encoding of a requested command can be accomplished by updating the value for the key. The emitters 24A, 24B and 24C can include the key for encoding an identification code for the requested command or operation, and phase selector 18 can also include the key for decoding the identification code.

The key of an emitter 24A, 24B and 24C can be a time-varying key that is synchronized or approximately synchronized with a time-varying key of the phase selector 18. The time-varying keys can prevent unauthorized activation by playback of a recorded transmission after the keys are updated.

FIG. 1 also shows an authorized person 21 operating a portable optical emitter 24C, which is there shown mounted to a motorcycle 23. In one embodiment, the emitter 24C is used to set in phase selector 18 a key used selecting the encoding of a requested command or operation. Typically, configuration of each phase selector 18, including setting the key, is manually perform by authorized maintenance personnel. In another embodiment, the emitter 24C is used by the authorized person 21 to affect the traffic lights 12 in situations that require manual control of the intersection 10.

Various embodiments of the invention can transfer the requested command or operation in a code with a fixed length (and in other embodiments with a protocol-defined variable length) from emitters 24A, 24B and 24C to detector assemblies 16A and 16B. Example operation identification codes include a vehicle identification code of a preemption request and a code to download information from an emitter 24C to phase selector 18. For a request to preempt the normal operation of the traffic lights 12, the code can be repeatedly continuously during transmission from emitters 24A and 24B to ensure initiation of preemption as soon as an emitter 24A or 24B comes into range of the intersection 10. For an operation that does not require a time-critical response from the phase selector 18, the code can vary during transmission to allow more information to be transferred from emitters 24A, 24B and 24C to detector assemblies 16A and 16B. For example, an operation to download information, such as an updated key, from an emitter 24C to phase selector 18 can begin with a download command in a first code in the stream of light pulses followed by the information to be downloaded in subsequent codes in the stream of light pulses.

In one embodiment, the operation identification code transferred from emitters 24A, 24B and 24C to detector assemblies 16A and 16B can be subdivided into various ranges. For example, a code with a fixed width of 14-bits has 16,384 potential values, and these codes can be subdivided into 10,000 vehicle identification codes and 6384 other "special" codes, as shown at code table 25. A value of zero can correspond to a default vehicle identification code that is not associated with any particular vehicle. The vehicle identification codes can be transmitted by emitters 24A, 24B and 24C to request preemption of the traffic lights 12. Following validation of the vehicle identification code by the phase selector 18, the phase selector can issue a traffic preemption command to the traffic signal controller 14 to select a particular phase of the traffic lights 12. The special codes can be used to command other operations, including a command to download a key to phase selector 18 from emitter 24C.

In one embodiment, each vehicle 20, 22, and 23 has a set of thumbwheel switches used by an administrator or operator for the vehicle to select a vehicle identification code for the vehicle from the codes of code table 25. In addition, the thumbwheel switches can be used to manually provide all or a portion of the key specifying the encoding for the optical emitter 24A, 24B, and 24C respectively mounted on vehicles 20, 22, and 23. For example, code table 25 can include 10,000 vehicle identification codes and 6384 special codes and selection of one of the 6384 special codes on the thumbwheel switches can update a value that is included in the key. In one embodiment, such a special code from the thumbwheel switches of emitter 24C can be transferred by authorized person 21 using a manually initiated key download command to phase selector 18 for use in the key for decoding. Generally, an update of the key should pass any validation process currently in force and potentially additional layers of security before the update is accepted by the phase selector 18.

Phase selectors constructed in accordance with the present invention can be configured to use an identification code in various ways. In one configuration, the phase selector 18 is provided with a list of authorized identification codes. The phase selector 18 confirms that the vehicle is indeed authorized to preempt the normal traffic signal sequence. If the transmitted code does not match one of the authorized codes on the list, preemption does not occur.

In another configuration, the phase selector 18 logs all preemption requests by recording the time of preemption, direction of preemption, duration of preemption, identification code, confirmation of passage of a requesting vehicle within a predetermined range of a detector, and denial of a preemption request due to improper authorization. Attempted abuse of an optical traffic preemption system can be discovered by examining the logged information.

In another embodiment of the present invention, an optical traffic preemption system helps run a mass transit system more efficiently. An authorized mass transit vehicle having an optical emitter constructed in accordance with the present invention, such as the bus 22 in FIG. 1, spends less time waiting at traffic signals, thereby saving fuel and allowing the mass transit vehicle to serve a larger route. This also encourages people to utilize mass transportation instead of private automobiles because authorized mass transit vehicles move through congested urban areas faster than other vehicles.

Unlike an emergency vehicle 20, a mass transit vehicle 22 equipped with an optical emitter may not require total preemption. In one embodiment, a traffic signal offset is used to give preference to a mass transit vehicle 22, while still allowing all approaches to the intersection to be serviced. For example, a traffic signal controller that normally allows traffic to flow 50 percent of the time in each direction responds to repeated phase requests from the phase selector to allow traffic flowing in the direction of the mass transit vehicle 22 to proceed 65 percent of the time and traffic flowing in the other direction to flow 35 percent of the time. In this embodiment, the actual offset can be fixed to allow the mass transit vehicle 22 to have a predictable advantage. Generally, proper authorization should be validated before executing an offset for a mass transit vehicle 22.

In a typical installation, the traffic preemption system does not actually control the lights at a traffic intersection. Rather, the phase selector 18 alternately issues phase requests to and withdraws phase requests from the traffic signal controller, and the traffic signal controller 14 determines whether the phase requests can be granted. The traffic signal controller 14 may also receive phase requests originating from other sources, such as a nearby railroad crossing, in which case the traffic signal controller 14 may determine that the phase request from the other source be granted before the phase request from the phase selector 18. However, as a practical matter, the preemption system can affect a traffic intersection 10 and create a traffic signal offset by monitoring the traffic signal controller sequence and repeatedly issuing phase requests that will most likely be granted.

According to a specific example embodiment, the traffic preemption system of FIG. 1 is implemented using a known implementation that is modified to implement the codes and algorithms discussed above for encoding and decoding. For example, an Opticom™ Priority Control System (manufactured by 3M Company of Saint Paul, Minn.) can be modified to implement the codes and algorithms discussed above for encoding and decoding. Consistent with features of the Opticom™ Priority Control System, one or more embodiments of U.S. Pat. No. 5,172,113 can be modified in this manner. Also according to the present invention, another specific example embodiment is implemented using another so-modified commercially-available traffic preemption system, such as the Strobecom II system (manufactured by TOMAR Electronics, Inc. of Phoenix, Ariz.).

Figure 2:
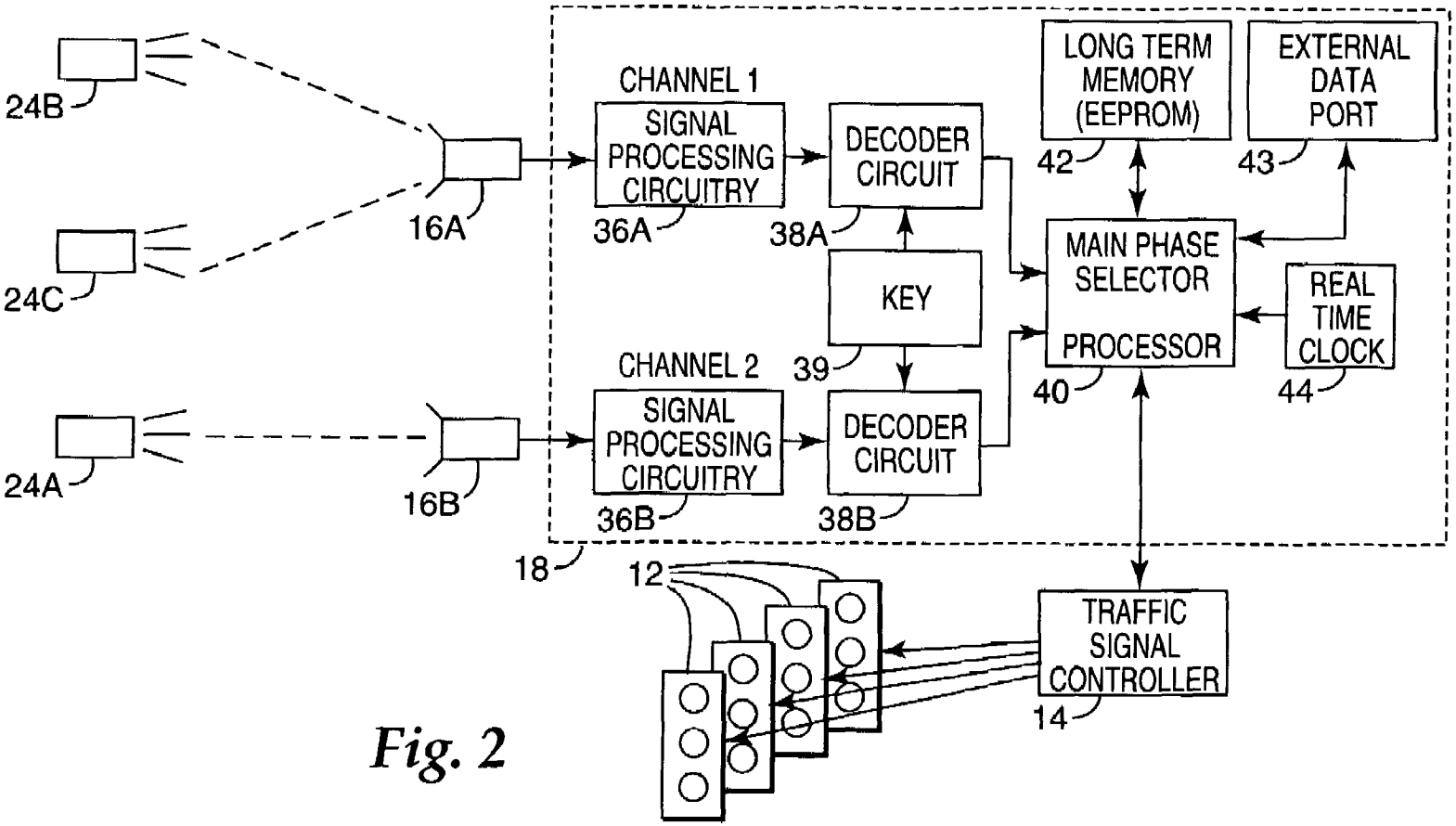
FIG. 2 is a block diagram of the components of the optical traffic preemption system shown in FIG. 1.

FIG. 2 is a block diagram showing the optical traffic preemption system of FIG. 1. In FIG. 2, light pulses originating from the optical emitters 24B and 24C are received by the detector assembly 16A, which is connected to a channel one of the phase selector 18. Light pulses originating from the optical emitter 24A are received by the detector assembly 16B, which is connected to a channel two of the phase selector 18.

The phase selector 18 includes the two channels, with each channel having signal processing circuitry (36A and 36B) and a decoder circuit (38A and 38B), a main phase selector processor 40, long term memory 42, an external data port 43 and a real time clock 44. The main phase selector processor 40 communicates with the traffic signal controller 14, which in turn controls the traffic lights 12.

With reference to the channel one, the signal processing circuitry 36A receives an analog signal provided by the detector assembly 16A. The signal processing circuitry 36A processes the analog signal and produces a digital signal, which is received by the decoder circuit 38A. The decoder circuit 38A extracts data from the digital signal, validates proper authorization and provides the data to the main phase selector processor 40. Channel two is similarly configured, with the detector assembly 16B coupled to the signal processing circuitry 36B which in turn is coupled to the decoder circuit 38B.

The long term memory 42 is implemented using electronically erasable programmable read only memory (EEPROM). The long term memory 42 is coupled to the main phase selector processor 40 and is used to store a list of authorized identification codes and to log data. It will be appreciated that key 39 can be stored in long term memory 42.

The decoder circuits 38A and 38B can use optional key 39 to decode the signal received from detector assemblies 16A and 16B. In one embodiment, a received vehicle identification code is decoded using the key and the resulting decoded vehicle identification code is checked against a list of authorized identification codes from long term memory 42.

The external data port 43 is used for coupling the phase selector 18 to a computer. In one embodiment, external data port 43 is an RS232 serial port. Typically, portable computers are used in the field for exchanging data with and configuring a phase selector. Logged data is removed from the phase selector 18 via the external data port 43 and key 39 and a list of authorized identification codes is stored in the phase selector 18 via the external data port 43. The external data port 43 can also be accessed remotely using a wired or wireless modem, local-area network or other such device.

Key 39 can be updated from a portable computer via external data port 43. In addition, main phase selector processor 40 can update key 39 in response to a command received from detector assemblies 16A and 16B to update the key 39.

The real time clock 44 provides the main phase selector processor 40 with the actual time. The real time clock 44 provides time stamps that can be logged to the long term memory 42 and is used for timing other events, including timed update of the key 39. In one embodiment, the key 39 is selected from a list stored in memory 42 at specified times, such as once a day. In another embodiment, the key 39 is generated from the date and time or another time-based parameter provided by the real time clock 44 or another natural parameter. For example, a hash algorithm of the date, time, and/or a current value for a manually provided base key is used to periodically generate values automatically for key 39. In yet another embodiment, the key 39 is updated with a new value at a particular time, such as three in the morning of the day after receiving the new value for key 39.

In an alternative embodiment, the validation algorithm uses multiple keys. For example, real time clock 44 can be incompletely synchronized with a similar real time clock in each of emitters 24A, 24B and 24C and decoding using two keys may compensate for keys that are periodically updated using incompletely synchronized real-time clocks. During a first half or other initial portion of the period for a key based on real-time clock 44, decoder circuits 38A and 38B can perform decoding using the key and the prior key. Decoding is successful if either decoding attempt succeeds. During a second half or other final portion of the period for a key based on real-time clock 44, decoder circuits 38A and 38B can similarly perform decoding using the key and the next key.

Figure 3:
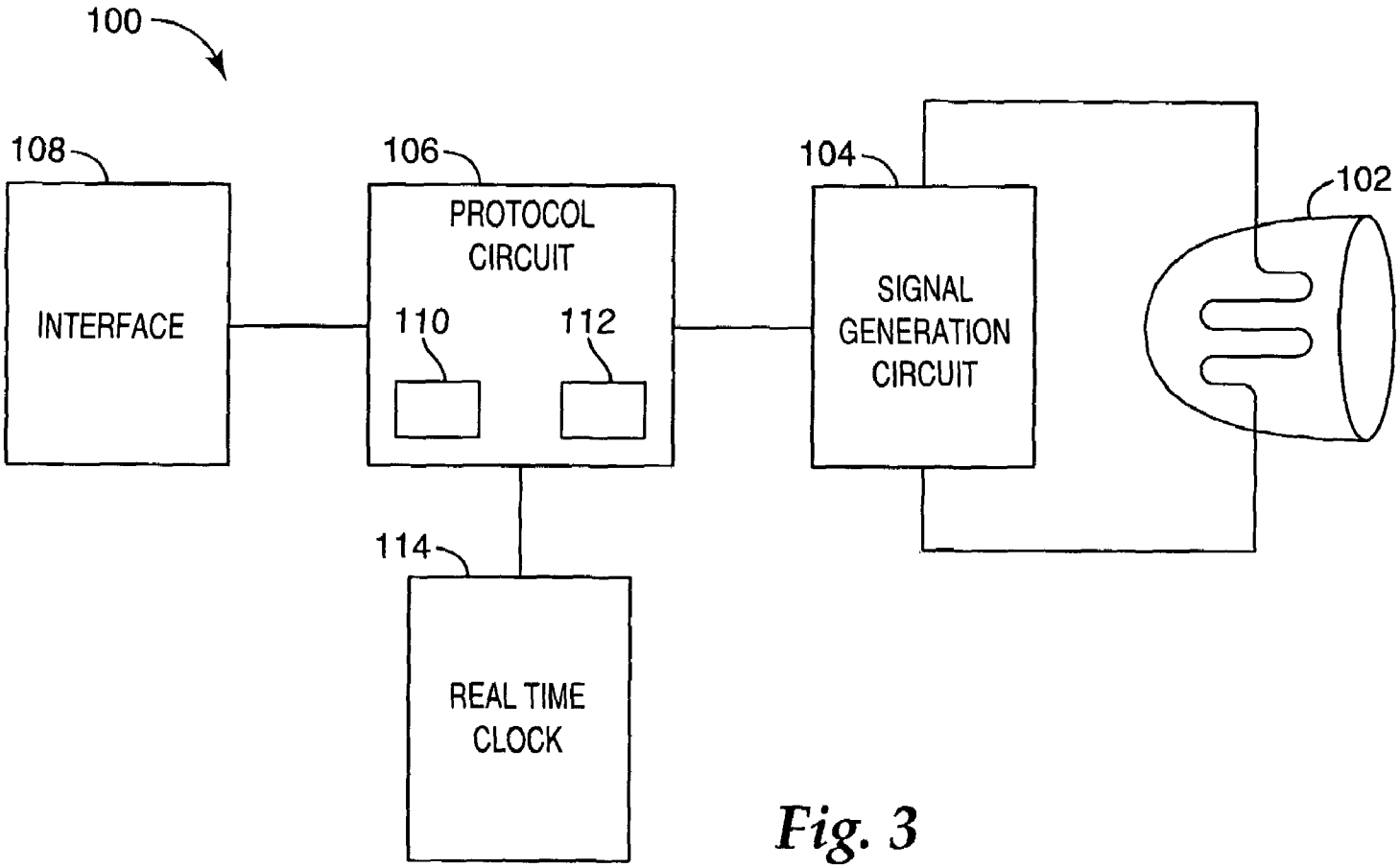
FIG. 3 is a block diagram of the components of an emitter for optical traffic preemption system for an embodiment in accordance with the present invention.

FIG. 3 is a block diagram of the components of an emitter for optical traffic preemption system for an embodiment in accordance with the present invention. An optical source 102, such as a Xenon flash tube or high intensity light emitting diode, on a vehicle emits short pulses of light that are received by a detector of a traffic light controller to request preemption of the normal operation of the traffic light to expedite passage of the vehicle through the traffic light.

A signal generation circuit 104 generates an output signal to control the flashes of light from optical source 102. The signal generation circuit 104 can include a transformer used to generate an output signal having high-voltage pulses that each trigger a Xenon strobe light to emit a pulse of light. Data specifying the timing of the pulses of the output signal can be provided by protocol circuit 106, with the pulses of the output signal using amplitude modulation and frequency modulation.

Protocol circuit 106 can generate the timing specification for the pulses of light emitted by optical source 102. Protocol circuit 106 can generate the timing specification of the pulses of light emitted by optical source 102 by generating the data words to be embedded in the optical pulse stream and encoding these data words to generate the timing specification for the pulses. The data words embedded in the optical pulse stream can include information specified at user interface 108.

In one embodiment, interface 108 includes an input device used by an operator or administrator of the vehicle carrying emitter 100 to specify one or more vehicle identification codes. Example input devices include thumbwheel switches and keypads. An operator setting up a vehicle identification code can additionally specify a key 110 for the emitter 100. For example, one digit of a multi-digit vehicle identification code can specify a key 110 causing emitter 100 to emit an optical pulse stream using a particular combination of amplitude modulation and frequency modulation. For ease of usage by an operator, the operator can be unaware that a portion of each vehicle identification code actually selects a key 110 instead of or in addition to being embedded in the transmitted optical pulse stream. In another embodiment, interface 108 includes a mechanism to specify default operation of the emitter or to configure operation of the emitter after manufacture, such as jumper settings within the enclosure of the emitter or externally configurable non-volatile storage.

Protocol circuit 106 can generate a specification of the optical pulse stream, including embedding a vehicle identification code received from user interface 108. Protocol circuit 106 can include storage circuits 112 providing protocol information such as a mapping of a particular bit of the vehicle identification code to the amplitude modulation and/or frequency modulation of a particular optical pulse.

In one embodiment, the information in a storage circuit 112 can be a protocol algorithm, such as protocol state transition diagrams or processor-executable code. The protocol circuit 106 can include a processor, such as a microprocessor, that executes the processor-executable code to create data, such as a specification of the optical pulse stream.

In another embodiment, the information in storage circuit 112 can be a logic implementation, such as a programmable logic array or programmable logic device configured with programming data for the modulation schemes. In yet another embodiment, the information in storage circuit 112 can be protocol tables, such as the next state and outputs as a function of the current state and inputs. Combinations of a protocol algorithm, a logic implementation, and tables can be used by protocol circuit 106 in an alternative embodiment. The contents of storage circuit 112 can be externally accessible to allow the manufacturer or an administrator of a fleet of vehicles to update the modulation schemes supported by protocol circuit 106.

Optical emitter 100 can have a real-time clock 114. The date and/or time from the real-time clock or another time-based parameter or other natural parameter can be used to select or modify the key 110. For example, a hash algorithm of the date and time, and potentially a manually updated base key, can be used to generate an updated value for the key 110 every ten minutes. The key 110 can be dependent on a manually provided base key, such as a base key provided on thumbwheel switches and/or from a coupled portable computer, and/or the current date and time. The key 110 can be manually updated, for example, in response to detection of unauthorized usage, and/or automatically updated based on the current data and time.

Figure 4A:
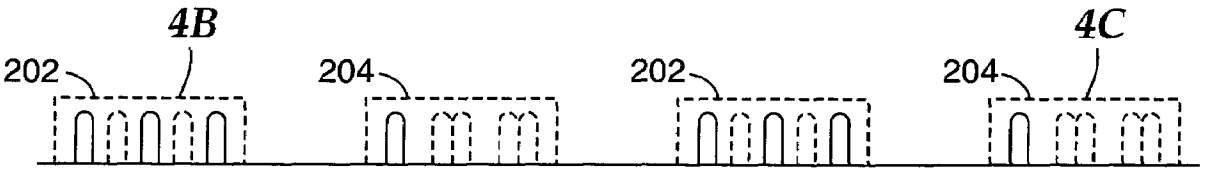
FIGS. 4A, 4B, 4C, 4D, and 4E illustrate optical pulses transmitted between a vehicle and equipment at an intersection for various example communication protocols in accordance with the present invention.
Figure 4B:
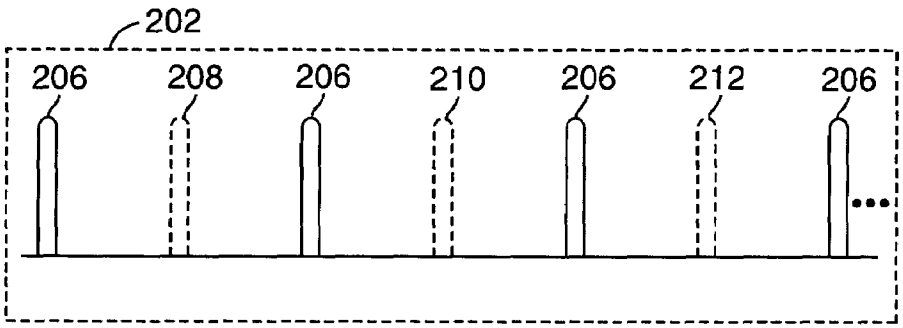
Figure 4C:
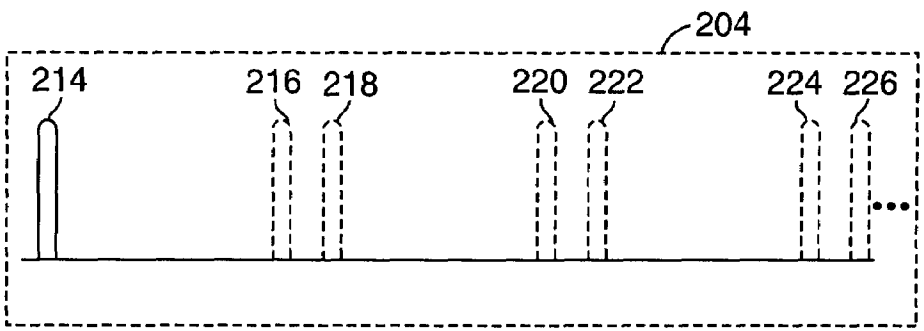

FIGS. 4A, 4B, 4C, 4D and 4E illustrate optical pulses transmitted between a vehicle and equipment at an intersection for an example communication protocol in accordance with the present invention. As illustrated in FIG. 4A, optical pulse stream 200 can alternate between a set 202 of light pulses using amplitude modulation and a set of light pulses 204 using frequency modulation. An example for each of sets 202 and 204 is illustrated in FIGS. 4B and 4C, enlarged to show detail.

As shown in FIG. 4B, set 202 of optical pulse stream 200 has major stroboscopic pulses of light 206 occurring at a particular frequency that typically is nominally either 10 Hz or 14 Hz. Between the major pulses, optional data pulses 208, 210, and 212 embed the encoded data words in the set 202 of optical pulse stream 200.

For example, if pulse 208 is present then an encoded data word has a first bit of one, and if pulse 208 is absent then the encoded data word has a first bit of zero. The value of a first bit of the encoded data word determines the amplitude modulation of either a full level for pulse 208 or a zero level for pulse 208. If pulse 210 is present then the encoded data word has a second bit of one, and if pulse 210 is absent then the encoded data word has a second bit of zero. Similarly, if pulse 212 is present then the encoded data word has a third bit of one, and if pulse 212 is absent then the encoded data word has a third bit of zero. Typically, the optional pulses 208, 210, and 212 are half-way between the major pulses 206. Another optical pulse stream that only includes sets of pulses 202 may correspond to the communication protocol of an Opticom™ Priority Control System.

As shown in FIG. 4C, set 204 of optical pulse stream 200 has stroboscopic pulses of light that nominally occur at a particular frequency that typically is approximately either 10 Hz or 14 Hz, but the pulses are displaced from the nominal frequency to embed the encoded data words in the optical pulse stream 200. For example, after an initial pulse 214, only one or the other of pulses 216 and 218 is present and if an early pulse 216 is present then an encoded data word has a first bit of zero and if late pulse 218 is present then the encoded data word has a first bit of one. The value of a first bit of the encoded data word determines the frequency modulation of either an early pulse 216 or a late pulse 218. Only one or the other of pulses 220 and 222 is present and if early pulse 220 is present then the encoded data word has a second bit of zero and if late pulse 222 is present then the encoded data word has a second bit of one. Similarly, only one or the other of pulses 224 and 226 is present and if early pulse 224 is present then the encoded data word has a third bit of zero and if late pulse 226 is present then the encoded data word has a third bit of one.

Typically, each pulse 216 through 226 is separated from the prior pulse with a nominal time period corresponding to the nominal frequency with the actual separation between a pulse and the prior pulse providing frequency modulation by being slightly less or slightly more than the nominal time period. An early pulse with a separation from the prior pulse of slightly less than the nominal time period embeds a data bit of zero and a late pulse with a separation from the prior pulse of slightly more than the nominal time period embeds a data bit of one. For example, if pulse 216 is present then a second bit of zero is embedded when pulse 220 is separated from pulse 216 by slightly less than the nominal time period, and if pulse 218 is present then a second bit of zero is embedded when pulse 220 is separated from pulse 218 by slightly less than the nominal time period. Another optical pulse stream that only includes sets of pulses 204 may correspond to the communication protocol of a Strobecom II system.

Figure 4D:
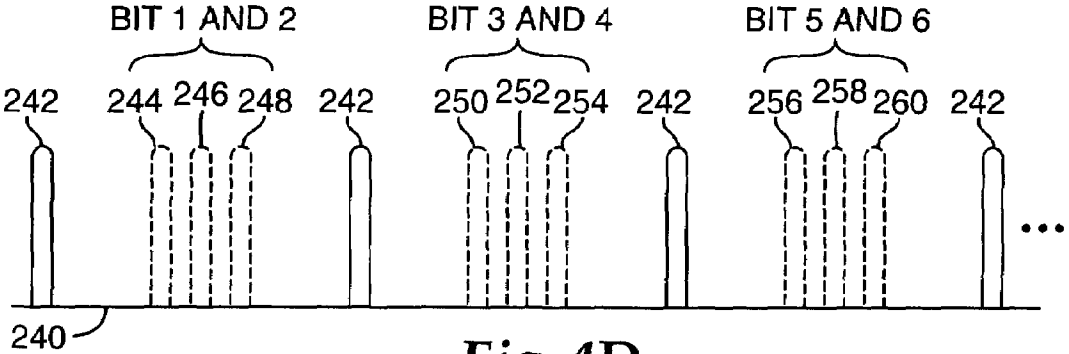

Optical pulse stream 240 of FIG. 4D has major stroboscopic pulses of light 242 occurring at a particular frequency that typically is nominally either 10 Hz or 14 Hz. Between the major pulses, optional data pulses 244 through 260 embed the encoded data words. Optical pulse stream 240 encodes two bits of the encoded data between each major light pulse 242. Optical pulse stream 240 permits more encoded data or duplicated encoded data to be transmitted within a given time interval as compared to an optical pulse stream that encodes only one bit of data between each major pulse. For example, optical pulse stream 240 may double the number of bits for encoded data from 14-bits to 28-bits, correspondingly increasing the number of possible vehicle identification codes from 16,384 possible codes to over 268 million possible codes.

A typical installation of a remotely-controller traffic preemption system could be configured with 1000 authorized vehicle identification codes. An unauthorized user may be readily able to "guess" an authorized vehicle identification code when 1000 of 16,384 possible codes are authorized. However, guessing authorized vehicle identification code is unlikely when 1000 of 268-million possible codes are authorized vehicle identification codes.

Optical pulse stream 240 can encode the first and second bits in data pulses 244, 246 and 248. The combination of the first and second bits has four possible values and pulses 244, 246 and 248 have four corresponding data pulse combinations. In a first combination, all pulses 244, 246 and 248 are absent. In a second combination, pulse 244 is present and pulses 246 and 248 are absent. In a third combination, pulse 246 is present and pulses 244 and 248 are absent. In a fourth combination, pulse 248 is present and pulses 244 and 246 are absent.

Typically, optical pulse stream 240 is generated by an optical emitter having a Xenon flash tube. The Xenon flash tube can emit an optical pulse by converting energy stored in a capacitor into a flash of light. Generally, the power supply for the Xenon flash tube takes some time to recharge the capacitor for the next flash of light. Thus, the time between optical pulses generally should exceed a value corresponding a capacitor recharge time. Typically, positions for optical pulses 244, 246 and 248 are separated by a time period that permits at most one of the optical pulses to be emitted.

Thus, the absence of any of the optical pulses 244, 246 and 248 or a pulse that is one of optical pulses 244, 246 and 248 can correspond to the amplitude modulation and/or frequency modulation of an optical pulse that is nominally in the pulse position for optical pulse 246. The absence of pulses 244, 246 and 248 can correspond to an amplitude modulation of zero amplitude and unknown frequency modulation. The presence of only optical pulse 246 can correspond to an amplitude modulation of full amplitude and a frequency modulation of zero shifting. The presence of only optical pulse 244 can correspond to an amplitude modulation of full amplitude and a frequency modulation of early shifting. The presence of only optical pulse 248 can correspond to an amplitude modulation of full amplitude and a frequency modulation of late shifting.

Figure 4E:
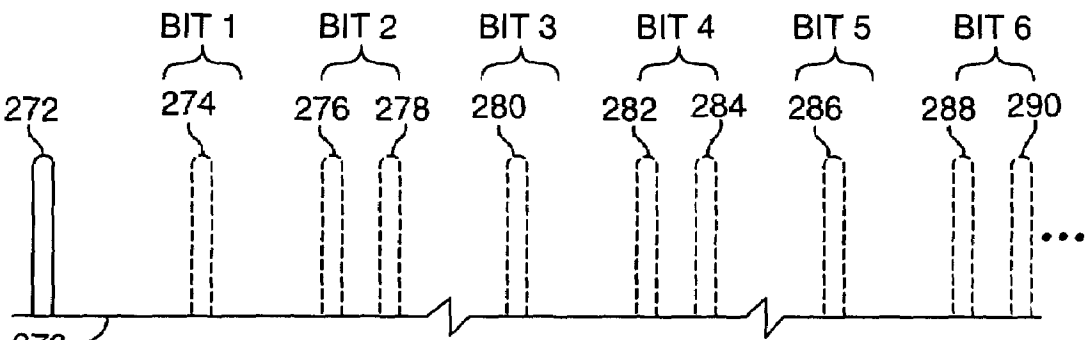

Optical pulse stream 270 of FIG. 4E combines pulse positions of sets 202 and 204 of optical pulse stream 200 from FIG. 4A, allowing more encoded data or duplicated encoded data to be transmitted within a given time interval. After an emitter transmits an initial pulse 272, the presence or absence of pulse 274 respectively provides a first bit of one or zero, and the presence of either of mutually exclusive pulses 276 or pulse 278 provides a second bit of zero or one. Optical pulses 274, 280, and 286 have respective amplitude modulation of either full amplitude or zero amplitude and optical pulses 276 or 278, 282 or 284, and 288 or 290 have frequency modulation of either early or late shifting. Additional bits three through six are similarly embedded by pulses 280 through 290.

In one embodiment, pulses 274, 280, and 286 are transmitted by an emitter one-half of the nominal period after the previous pulse. For example, if pulse 276 is present then pulse 280 is transmitted one-half of the nominal period after pulse 276 and if pulse 278 is present then pulse 280 is transmitted one-half of the nominal period after pulse 278. In another embodiment, pulses 274, 280, and 286 are transmitted half-way between the previous and following pulses.

The nominal frequency used to transmit pulses of an optical pulse stream 200, 240, and 270 can determine a priority. For example, a frequency of approximately 10 Hz can correspond to a high priority for an emergency vehicle and a frequency of approximately 14 Hz can correspond to a low priority for a mass transit vehicle.

Figure 5:
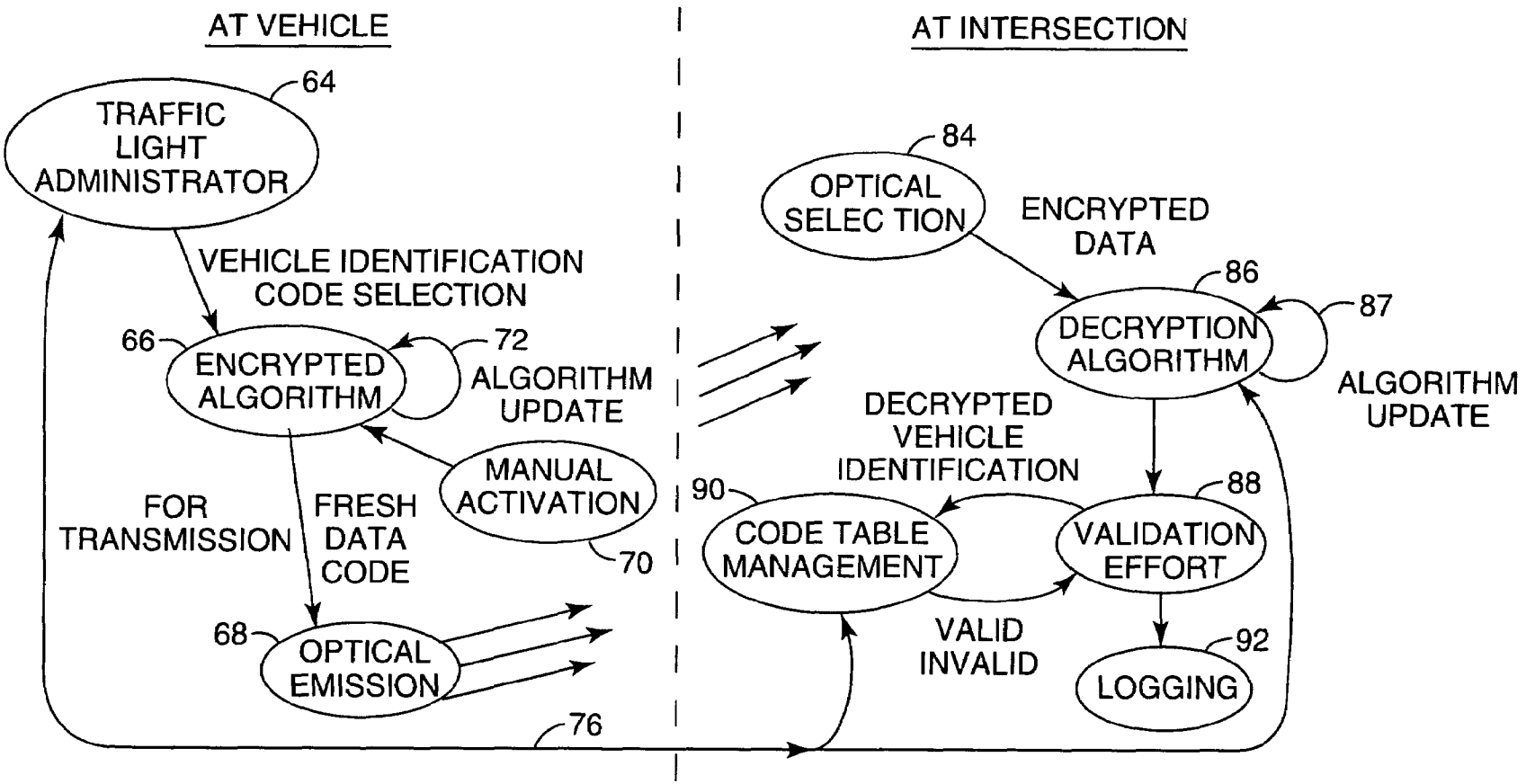
FIG. 5 is a flow diagram of the operation of the optical traffic preemption system at a vehicle and an intersection in accordance with the present invention.

FIG. 5 is a flow diagram of the operation of the optical traffic preemption system at a vehicle and an intersection in accordance with the present invention. As in FIG. 2, operation/activity of the equipment at the vehicle is shown at the left side of the illustration and operation/activity of the equipment at the intersection is shown at the right side of the illustration. At the vehicle, the operator of the vehicle or an agent of the system administrator selects the unique vehicle identification code for the vehicle (and its associated emitter equipment). Such an agent is shown at node 64, with a connecting data line showing the unique vehicle identification code being passed to the vehicle at activity node 66. The key for encoding the vehicle identification code can be preinstalled in the vehicle, passed by the agent (line 76), and/or automatically changed as a function of a natural parameter (e.g., every second Tuesday of each month at 11:58 pm Central), as a function of an algorithm (per the updates at data lines 72 and 87), and/or as a function of an irregular parameter such as pseudo-random sequence identifying a time at which this key changes and/or the manner in which the key changes. Node 70 depicts another optional feature in which the encoding operation at node 66 is only enabled in response to a special enable command being manually entered. Each such manual data entry can be readily implemented using conventional touch keys or other types of switches for selecting the appropriate codes.

Once enabled and equipped with the appropriate code selection, the light pulse signaling can be emitted from the vehicle-installed equipment toward the equipment at the intersection, as shown at node 68. As shown at node 84, the light pulse signaling is detected at the intersection and a data signal is passed to node 86. Assuming that the vehicle identification code is authorized, the data signal includes the vehicle identification code as encoded using the key selected as discussed above in connection with 25 of FIG. 1. At node 86, the received date is decrypted using the key and, if the key and/or algorithm has been updated (per line 87), using the updated information. Before phase selection, another data processing module validates the preemption attempt (node 88) by comparing the decode data signal (e.g., vehicle identification code) with authorized codes as stored at the code management table (node 90). The preemption attempt (whether or not successful) is logged (node 92) as is conventional in the above-discussed embodiments and commercial systems.

While certain aspects of the present invention have been described with reference to several particular example embodiments, those skilled in the art will recognize that many changes may be made thereto. For example, the optical emitter and detector circuitry, as well as the data signal processing (data look-up, data sending and formatting, and data encoding and decoding) can be implemented using a signal processing circuit arrangement including one or more processors, volatile and/or nonvolatile memory, and a combination of one or more analogy, digital, discrete, programmable-logic, semi-programmable logic, non-programmable logic circuits. Examples of such circuits for comparable signal processing tasks are described in the previously-discussed commercial devices and various references including, for example, U.S. Pat. No. 5,172,113, U.S. Pat. No. 5,519,389, U.S. Pat. No. 5,539,398 and U.S. Pat. No. 4,162,447. Such implementations and adaptations are embraced by the above-discussed embodiments without departing from the spirit and scope of the present invention, aspects of which are set forth in the following claims.

What is claimed is:

1. A remotely-controlled traffic-preemption system, comprising:

an encoder circuit adapted to generate a set of signal pulses, wherein at least one bit of a data word is encoded as a function of amplitude modulation of a first subset ot the set of signal pulses and at least another bit of the data word is encoded as a function of frequency modulation of a second subset of the set of signal pulses;

an optical source adapted to transmit a set of light pulses having a respective light pulse for each signal pulse of the set of signal pulses;

an optical detector adapted to receive the set of light pulses; and a decoder circuit adapted to generate the data word from the set or light pulses received at the optical detector.

2. The system of claim 1, wherein the encoder circuit and the decoder circuit are each further adapted to modify the optical pulses included in the first and second subsets responsive to a key.

3. The system of claim 1, wherein the optical source is mounted to a vehicle and the data word includes a vehicle identification code associated with the vehicle.

4. The system of claim 1, wherein the decoder circuit is further adapted to issue a traffic-preemption command for an associated traffic light responsive to the data word.

5. The system of claim 1, wherein the first subset of the set of the signal pulses and the second subset of the set of the signal pulses do not share any signal pulse.

6. The system of claim 1, wherein the first subset of the set of the signal pulses and the second subset of the set of the signal pulses share at least one signal pulse.

7. A communication method for use in a remotely-control traffic-preemption system, the method comprising:

encoding at least one bit of a data word as a function of amplitude modulation of a first subset of a set of optical pulses; and encoding at least another bit of the data word as a function of frequency modulation of a second subset of the set of optical pulses;

transferring the set of optical pulses to an optical detector; and decoding the data word from the optical pulses received at the optical detector.

8. The communication method of claim 7, further comprising modifying the optical pulses included in the first and second subsets in response to a key.

9. The communication method of claim 7, wherein an optical emitter is mounted to a vehicle, the data word includes a vehicle identification code associated with the vehicle, and transferring the set of optical pulses to the optical detector includes transmitting the set of optical pulses from the optical emitter and receiving the set of optical pulses at the optical detector.

10. The communication method of claim 7, further comprising attempting to validate the data word and selecting a phase for an associated traffic light in response to the validation of the data word.

11. The communication method of claim 7, wherein the first subset of the set of the optical pulses and the second subset of the set of the optical pulses do not share any signal pulse.

12. The communication method of claim 7, wherein the first subset of the set of the optical pulses and the second subset of the set of the optical pulses share at least one signal pulse.

13. An optical emitter for a remotely-controlled traffic-preemption system, the optical emitter comprising:

an encoder circuit adapted to generate a set of signal pulses, wherein at least one bit of a data word is encoded as a function of amplitude modulation of a first subset of the set of signal pulses and at least another bit of the data word is encoded as a function of frequency modulation of a second subset of the set of signal pulses; and an optical source adapted to transmit a set of light pulses having a respective light pulse for each signal pulse of the set of signal pulses.

14. The system of claim 13, wherein the encoder circuit is further adapted to modify the optical pulses included in the first and second subsets responsive to a key.

15. The optical emitter of claim 13, wherein the optical source is mounted to a vehicle and the data word includes a vehicle identification code associated with the vehicle.

16. The optical emitter of claim 13, wherein the first subset of the set of the signal pulses and the second subset of the set of the signal pulses do not share any signal pulse.

17. The optical emitter of claim 13, wherein the first subset of the set of the signal pulses and the second subset of the set of the signal pulses share at least one signal pulse.

18. A phase selector for a remotely-controlled traffic-preemption system, the phase selector comprising:

an optical detector adapted to receive the set of light pulses, wherein at least one bit of a data word is encoded as a function of amplitude modulation of a first subset of the set of light pulses and at least another bit of the data word is encoded as a function of frequency modulation of a second subset of the set of light pulses; and a decoder circuit adapted to generate the data word from the set of light pulses received at the optical detector.

19. The phase selector of claim 18, wherein the data word includes a vehicle identification code associated with a vehicle transmitting the set of light pulses and the decoder circuit is further adapted to attempt to validate the vehicle identification code.

20. The phase selector of claim 19, wherein the decoder circuit is further adapted to issue a command selecting a phase for an associated traffic light responsive to the validation of the vehicle identification code.

* * * * *